United States Patent [19]

Suda

[11] 4,044,733

[45] Aug. 30, 1977

[54] IGNITION APPARATUS FOR INTERNAL COMBUSTION ENGINE

[75] Inventor: Seiji Suda, Mito, Japan

[73] Assignee: Hitachi, Ltd., Japan

[21] Appl. No.: 572,859

[22] Filed: Apr. 29, 1975

[30] Foreign Application Priority Data

Apr. 30, 1974 Japan ..... 49-47669

[51] Int. Cl.[2] ..... F02P 5/04

[52] U.S. Cl. ..... 123/117 R; 123/148 E

[58] Field of Search ..... 123/148 E, 117 R

[56] References Cited

U.S. PATENT DOCUMENTS

| | | | |
|---|---|---|---|
| 3,390,668 | 7/1968 | Hufton | 123/148 CB |
| 3,559,629 | 2/1971 | Sauvignet | 123/148 E |
| 3,831,571 | 8/1974 | Weber | 123/148 E |
| 3,871,347 | 3/1975 | Weber | 123/117 R |
| 3,881,458 | 5/1975 | Roozenbeek et al. | 123/117 R |
| 3,890,944 | 6/1975 | Werner et al. | 123/146.5 A |
| 3,900,015 | 8/1975 | Gainprige | 123/148 E |
| 3,916,855 | 11/1975 | Fauser et al. | 123/148 E |
| 3,935,845 | 2/1976 | Sono et al. | 123/117 R |

*Primary Examiner*—Carroll B. Dority, Jr.
*Assistant Examiner*—Paul Devinsky
*Attorney, Agent, or Firm*—Craig & Antonelli

[57] ABSTRACT

An ignition apparatus wherein an AC current signal is produced from the coil of a pick-up in accordance with the engine revolutions and the primary-side current of the ignition coils is regulated in accordance with the output signal from the pick-up coil thereby to generate a high voltage at the secondary side of the ignition coils. Further, a monostable multivibrator and means for generating a voltage corresponding to the output frequency of the pick-up coil are provided in order to maintain the duration of energization of the primary side of the ignition coils substantially constant over a wide range of variations of engine revolutions from low to high levels. The monostable multivibrator is so connected that the output width thereof which is controlled by the output of the voltage generator means is long in low engine revolutions and short in high engine revolutions, that the output is produced upon completion of ignition, and that the primary-side current of the ignition coils begins to flow at the end of the output of the monostable multivibrator which is determined by the output of the pick-up or that of the monostable multivibrator, whichever is produced earlier.

6 Claims, 5 Drawing Figures

IGNITION APPARATUS FOR INTERNAL COMBUSTION ENGINE

The present invention relates to an ignition apparatus for the internal combustion engine, or more in particular to a transistor ignition apparatus which consumes less electric power at low revolutions.

It is generally known that ignition energy may be increased and a speed characteristic improved by increasing the current flowing in the ignition coils of the ignition apparatus, thereby leading to advantageous fuel regulation and exhaust gas protection. In other words, the ignition energy is proportional to the square of a current supplied to the primary coil of the ignition coils and also proportional to the reactance of the primary coil. Ignition energy required is substantially fixed in amount when the type of engines used is determined and therefore the reactance may be decreased when a current supplied to the primary coil is increased by using a larger diameter of winding wires for the primary coil, so that the miniaturization of the ignition coils may be achieved and also the current flowing in the primary coil may be rednered to rise earlier, thus making it possible to effect accurate regulation of the ignition timing even at high revolutions of the internal combustion engine. For example, the ignition time control device is so constructed that a current is made to flow in the primary coil during the stable state of the monostable multivibrator circuit driven by an ignition time detection signal and the current is cut off during the metastable state thereof. As a result, the duration of energization of the ignition coils lasting for several seconds is secured and ample ignition energy obtained even at high revolutions of the engine.

In the above-mentioned circuit, however, the energization time of the primary coil is lengthened, resulting in an increased power consumption and load on the battery, at low engine revolutions. Further, a measure must be taken against the heat generated in the ignition apparatus.

For this reason, a method has been suggested in which the amount of current flowing in the primary coil is controlled below a predetermined value thereby to reduce the power consumption. Such a method actually used consists in regulating the bias potential impressed on the AC pulse voltage induced in the pick-up coil, in accordance with the amount of current flowing in the primary coil, by taking into consideration the ignition time, thereby changing the duration of energization of a switching transistor.

In such a method, however, the level of the output of the pick-up coil to be responded to is different at low engine revolutions from that at high revolutions. In other words, the time when the switching transistor is cut off, namely, the ignition starting time varies against the normal ignition time detected by the pick-up coil, thus making an accurate ignition time control impossible.

An object of the present invention is to provide an ignition apparatus capable of reducing power consumption at low revolutions of the engine.

Another object of the present invention is to provide an ignition apparatus capable of accurate ignition time control.

The ignition apparatus according to the present invention, in which the primary-side current of the ignition coils is controlled in accordance with the output of the pick-up coil produced in synchronism with the engine revolutions, is provided with means for generating a voltage corresponding to the engine revolutions and pulse generator means for generating a pulse with the width thereof varying with the output voltage of the voltage generator means. The pulse width of the output signal of the pulse generator means becomes shorter the higher the revolutions of the engine. Simultaneously with the generation of an ignition spark by the ignition apparatus, the pulse generator means produces a pulse at the end of which the primary current begins to flow in the ignition coils. Further, the circuit configuration is such that the primary current of the ignition coils begins to flow in response to the output from the pick-up coil. As a result, the time point when the primary current begins to flow in the ignition coils is determined by the output of the pick-up coil or that of the pulse generator means, whichever is produced earlier. In the above-mentioned construction, the time point when the primary current flows in the ignition coils is determined by the output of the pick-up coil at comparatively low levels of engine revolutions, and by the output of the pulse generator means at high revolutions of the engine.

According to the present invention, there is provided in an ignition apparatus for the internal combustion engine comprising means for generating an AC signal in predetermined time relationship with the engine revolutions, a DC power supply, ignition coils having at least a primary coil, power regulating means for regulating the current flowing from the DC power supply into the primary coil of the ignition coils, and a switching circuit energized in response to the output from the AC signal generator means, the power regulating means being energized by the output of the switching circuit, thereby regulating the current in the primary coil of the ignition coils and generating a high voltage at the output terminal of the ignition coils: the improvement further comprising means for generating a voltage in accordance with the revolutions of the engine, and means for generating pulses of which the width varies with the output of the voltage generator means, the pulse generator means being so connected that the power regulating means is energized by the pulse output of the pulse generator means at high revolutions of the engine and by the output of the switching circuit at low revolutions of the engine.

The above and other objects, features and advantages will be made apparent by the detailed description taken in conjunction with the accompanying drawings, in which.

Figure 1:
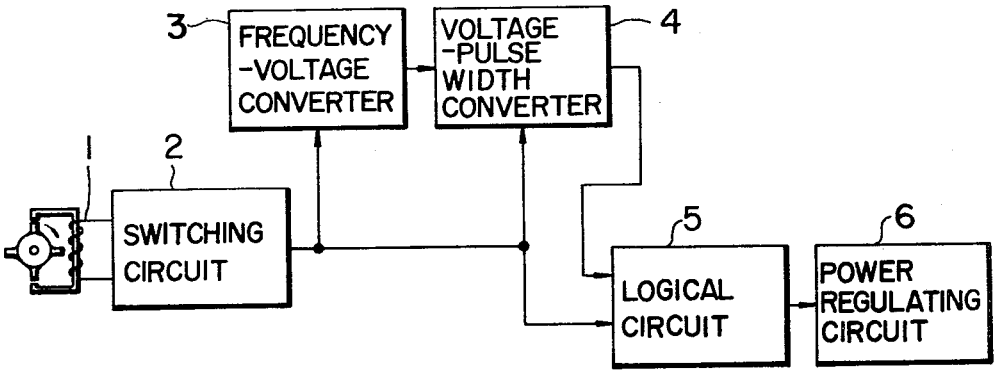
FIG. 1 is a diagram showing the construction of an embodiment of the present invention.

The circuit configuration of the ignition apparatus according to an embodiment of the invention is shown in FIG. 1, in which an ignition time detector of the magnet generator type is used. In this type of detector, a voltage is generated across the pick-up coil 1 at the time of ignition, while no voltage is induced in the pick-up coil when the engine is stationary. In response to the voltage induced in the pick-up coil, a pulse is generated in the switching circuit 2. This pulse is converted into a voltage corresponding to the frequency thereof by the frequency-voltage converter circuit 3. In response to this voltage corresponding to the frequency and the signal from the pick-up coil, a pulse having the width corresponding to the frequency is formed by the voltage-pulse width converter circuit 4. Upon receipt of the output signal from the switching circuit 2 and the output signal from the voltage-pulse width converter circuit 4, the logical circuit 5 produces one of the two inputs applied thereto which is shorter in pulse width and applies it to the power regulating circuit 6 for energizing the same thereby to turn on and off the ignition coil current.

The circuit is so arranged that the output of the voltage-pulse width converter circuit 4 is longer in pulse width than that of the switching circuit 2 below a predetermined frequency, namely, below predetermined revolutions, so that the time point of energization of the primary coil of the ignition coils is determined according to the output of the switching circuit 2 which is in turn based on the output of the pick-up coil 1, during the engine operation at low revolutions. As a result, the duration of the energization of the primary coil of the ignition coils is maintained for substantially a fixed time by the output of the switching circuit 2.

At high revolutions of the engine where the time during which the primary current flows in the ignition coils otherwise might be shortened in response to the output of the switching circuit 2, the flow time of the primary current in the ignition coils is lengthened to attain a predetermined value in accordance with the output of the voltage-pulse width converter circuit 4.

The present invention will be explained more in detail with reference to the embodiment shown in FIG. 2. The switching circuit 2 comprises resistors R1, R2, R3, R4, R15, R16, diodes D1, D2, D3, capacitors C1, C3 and a transistor TR1. While the output of the pick-up coil PU is rendered zero by the resistor R1 and the diode D2, the base current flows in the transistor TR1 from the batter 10 through the resistors R16, R2 and R3, thereby turning on the transistor TR1. Therefore, when the output of the pick-up coil PU is positive or zero, the transistor TR1 conducts, and it is turned off when the output of the pick-up coil PU is negative.

The diodes D1 and D3 are for preventing the breakdown of the transistor TR1 and the diode D2 by a reverse voltage, and the capacitor C1 is for removing the noise signal disturbing the pick-up coil PU. The frequency-voltage converter circuit 3 is comprised of capacitors C8, C6, diodes D5, D6 and a resistor R10 for producing a voltage corresponding to the frequency across the capacitor C6. The resistor R10 is for providing a certain ceiling to the voltage produced across the capacitor C6 at high levels of revolutions.

During the conduction of the transistor TR3, charges stored in the capacitor C8 are released through the diode D6, resistor R10 and transistor TR3. Under this condition, the diode D5 is reversely biased and therefore the capacitor C6 does not discharge. When the transistor TR3 is turned off, a charge current flows in the capacitor C6 through the resistor R11, capacitor C8 and diode D5. The value of this current is larger, the smaller the electric charge in the capacitor C8. At high engine revolutions, the transistor TR3 is turned on repeatedly in short cycles and therefore the charges in the capacitor C6 are increased.

At the low engine revolutions, as soon as the transistor TR3 is turned off, the charging of the capacitor C8 is completed thereby to prevent ample charge current from flowing in the capacitor C6 since the capacitance of the capacitor C8 is smaller than that of capacitor C6. From the low to medium revolutions of the engine, it may well be considered that a substantially fixed amount of charge is supplied to the capacitor C6 each time of the turning-off of the transistor TR3, with the result that with the increase in revolutions, the stored charge in the capacitor C6 is increased. At very high engine revolutions, the capacitor C8 discharges through the resistor R10 but only to an insufficient degree, so that a smaller charging current flows in the capacitor C6 each time, thus preventing the voltage across the capacitor C6 from being increased.

The voltage-pulse width converter circuit 4 may be thought as a kind of monostable multivibrator comprising the resistors R6, R7, R8, R9 and R11, capacitor C7, diode D4 and transistors TR2 and TR3. The duration of the semistable state of the monostable multivibrator is determined by the terminal voltages across the capacitor C7, resistors R9 and R6 and capacitor C6, and the pulse width of the output thereof determined in accordance with the frequency. Even though there is no special circuit arrangement for the logical circuit 5 in FIG. 2, a similar function is attained in the circuit under consideration by applying the output signal of the switching circuit 2 to the anode of the diode D4 through a parallel circuit including the capacitor C5 and the resistor R5.

The power amplifier circuit 6 comprises resistors R12 and R13, a switching transistor TR4, a diode D7, and a capacitor C9. The capacitor C9 and the zener diode ZD are for absorbing the surge voltage which occurs at the time of generation of a spark discharge.

The turning on of the transistor TR4 causes electric current to flow from the battery 10 to the primary coil of the ignition coils 12. Next, when the transistor TR4 is turned off, a high voltage is generated on the secondary side of the ignition coils and a spark is produced through an ignition plug (not shown in the drawing).

By the way, the diode D9, capacitors C10 and C12 are provided for absorbing the surge and ripple voltages occurring in the power supply line.

Figure 3:
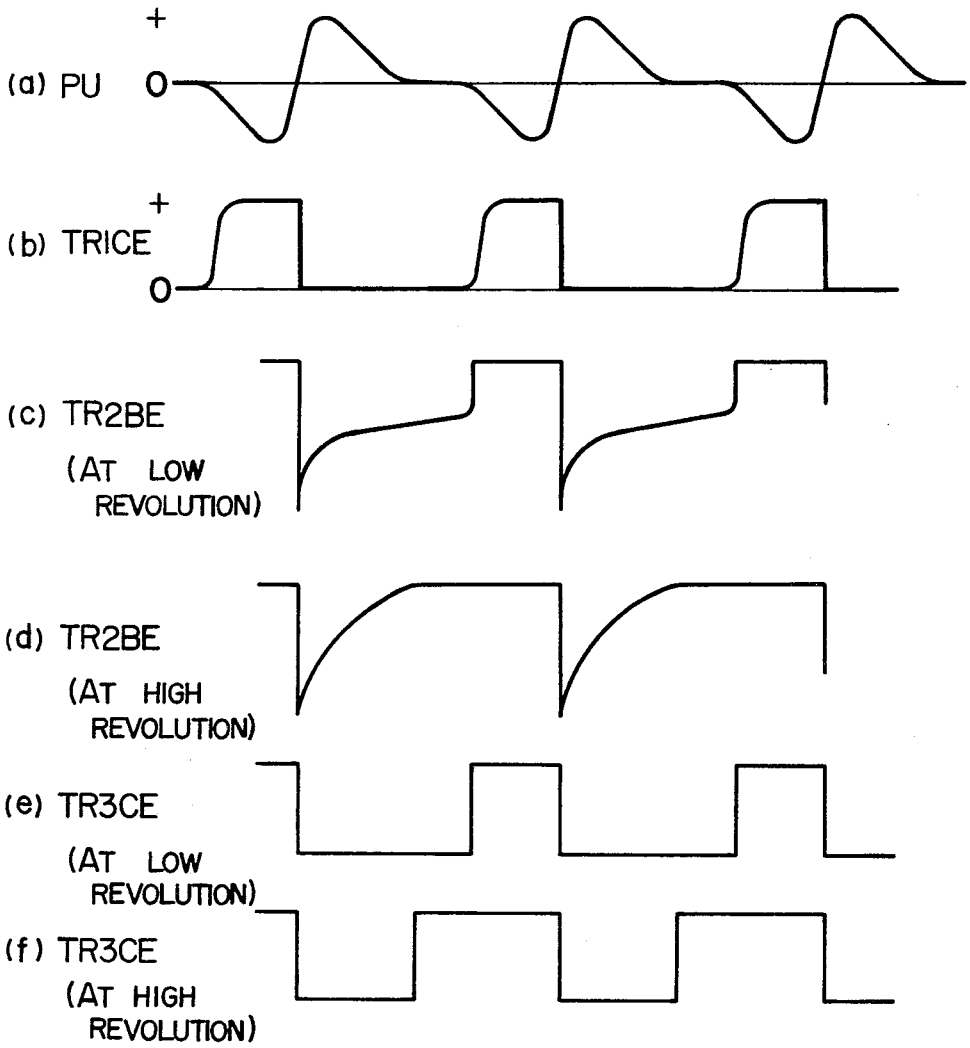
FIG. 3 is a diagram for explaining the operation of the circuit shown in FIG. 2.

The operation of the above-mentioned circuit will be explained below with reference to FIG. 3.

The transistor TR1 is turned on at the time point when the output of the pick-up coil PU changes from negative to positive. During the cut-off state of the transistor TR3, the capacitor C6 is charged through the capacitor C8 and the diode D5, and the resulting stored charges are discharged through the resistor R6 and the capacitor C5 when the transistor TR1 is turned on. At low engine revolutions, the terminal voltage of the capacitor C6 is reduced.

The transistors TR2 and TR3 constitute a monostable multivibrator. When the transistor TR1 is conducting, the base current in the transistor TR2 is reduced through the capacitor C5, thereby cutting off the transistor TR2, while turning on the transistor TR3. Due to the charge voltage of the capacitor C7, the diode D4 for generating the base current of the transistor TR2 is reversely biased, so that the transistor TR2 remains turned off and the transistor TR3 turned on, respectively, till the capacitor C7 discharges under the turned-off state of the transistor TR1. When the transistor TR3 is conducting, the base current of the transistor TR4 is decreased by a current flowing through the diode D7, and then the transistor TR4 is turned off.

At low engine revolutions where the charge voltage of the capacitor C6 is low, little charge current flows in the capacitor C7 from the capacitor C6 through the resistors R6 and R9, with the result that it takes a very long time before the transistor TR2 is turned on. When the output of the pick-up coil as shown in (*a*) of FIG. 3 changes from positive to negative levels, the transistor TR1 changes from a turned-on to a turned-off state, so that the collector potential of the transistor TR1 becomes as shown in (*b*) of FIG. 3. When the transistor TR1 is turned off, the base current flows in the transistor TR2 through the resistor R5, with the result that the transistor TR2 is turned on and the transistor TR3 turned off in spite of the fact that the capacitor C7 has not yet well discharged. The transistor TR4 is turned on and a current flows in the ignition coils 12 from the battery 10. As a consequence, a current begins to flow in the ignition coils 12 at the time point determined by the output of the pick-up coil PU.

In the circuit under consideration, the output of the pick-up coil PU is zero and therefore the transistor TR1 is kept turned on while the engine is stopped. The switching transistor TR4 is turned off and the ignition coil current is reduced to zero. At medium revolutions of the engine, the terminal voltage of the capacitor C6 is increased comparatively, so that the terminal voltage across the capacitor C7 is increased through the resistors R6 and R9. The current flows from the capacitor C6 to the base of the transistor TR2, thereby turning on the transistor TR2 promptly after the turning on of the transistor TR1. As a result, the energization time of the primary coil is advanced from the time point determined by the output of the pick-up coil PU. Thus, even when the terminal voltage of the capacitor C6 is further increased and the transistor TR1 is turned on at high revolutions, the base current of the transistor TR2 is supplied from the capacitor C6 through the resistor R6 and the diode D4 after the lapse, from the ignition time, of a period of time determined by the terminal voltages of the resistors R6 and R9 and the capacitors C7 and C6, whereupon the transistor TR2 is turned on thereby to turn on the transistor TR4. Such an operation is illustrated in (*c*), (*d*), (*e*) and (*f*) of FIG. 3. at low revolutions, the off time of the transistor TR3 depends on the off time of the transistor TR1, whereas the transistor TR3 is turned off in advance of the transistor TR1 at high revolutions of the engine. In other words, the time point when current flows in the ignition coils may be advanced in accordance with the frequency.

Figure 4:
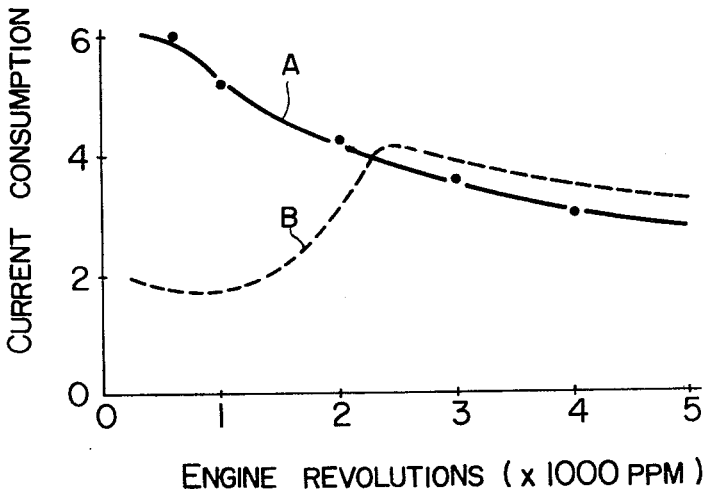
FIG. 4 is a diagram comparing the present invention with an example of the prior art.

In FIG. 4, the current consumed by a conventional ignition apparatus (A) with the constant duty cycle of 70% in which the energization time is not regulated is compared with that consumed by the ignition apparatus (B) according to an embodiment of the present invention. The embodiment shown in the drawing is so controlled that the duty cycle is small at low revolutions of the engine, that the duty cycle is gradually increased at medium revolutions, and that it is maintained constant at 80% at high revolutions.

As will be understood from the drawing, it is possible to sharply reduce the current consumption at low revolutions. At high revolutions, on the other hand, the duty cycle can be enlarged and therefore the current in the ignition coils increased, thus making it possible to effect ignition at high energy.

Figure 2:
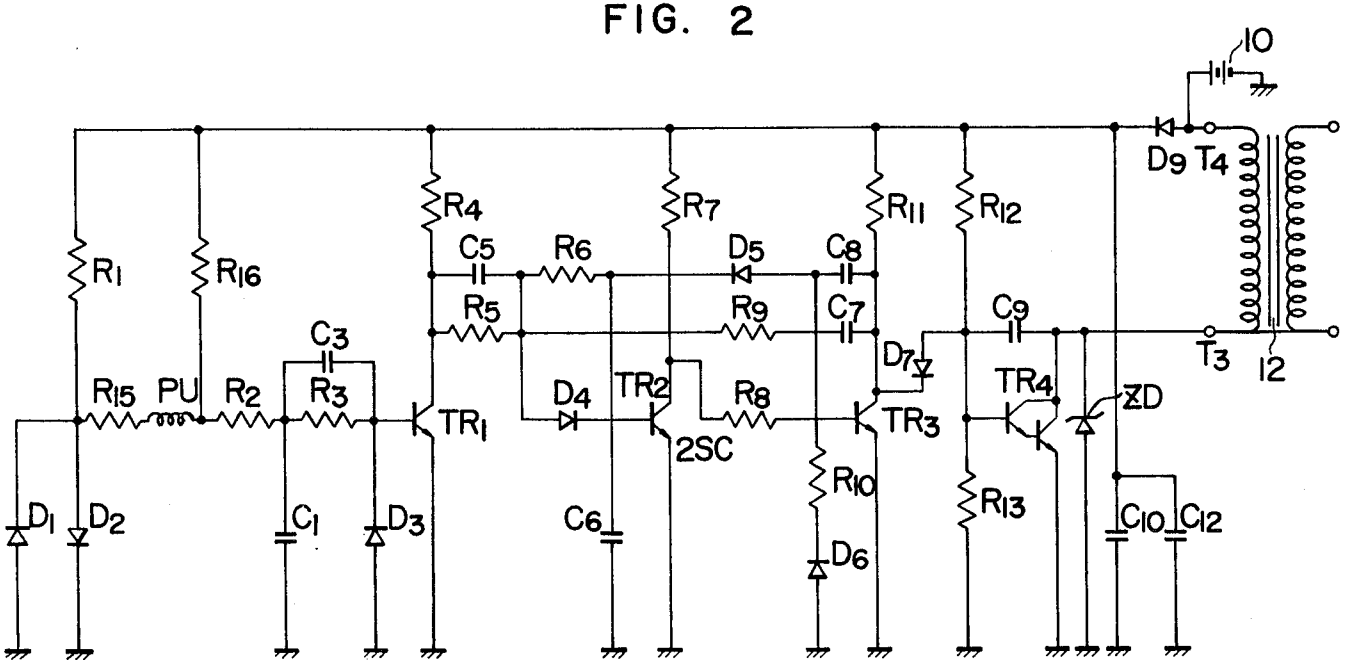
FIG. 2 is a diagram showing the construction of an actual circuit according to the embodiment of FIG. 1.

Also, in the embodiment shown in FIG. 2, the duration of energization of the primary coil is regulated by changing the time point at which the energization begins regardless of the ignition time. And the time at which the current in the primary coil is cut off is always controlled so as to correspond to the ignition time detected by the pick-up coil. As a result, the ignition time does not vary with the revolutions.

Further, in the event that the engine stops for some reasons or other when the key switch is closed, the ignition coils of the conventional ignition apparatus are likely to be destroyed by heat or the battery to discharge since the current is left to flow in the ignition coils. According to the present invention, by contrast, the current in the ignition coils is reduced automatically to zero at the time of engine stop, thus eliminating the above-mentioned shortcoming of the conventional apparatus.

Figure 5:
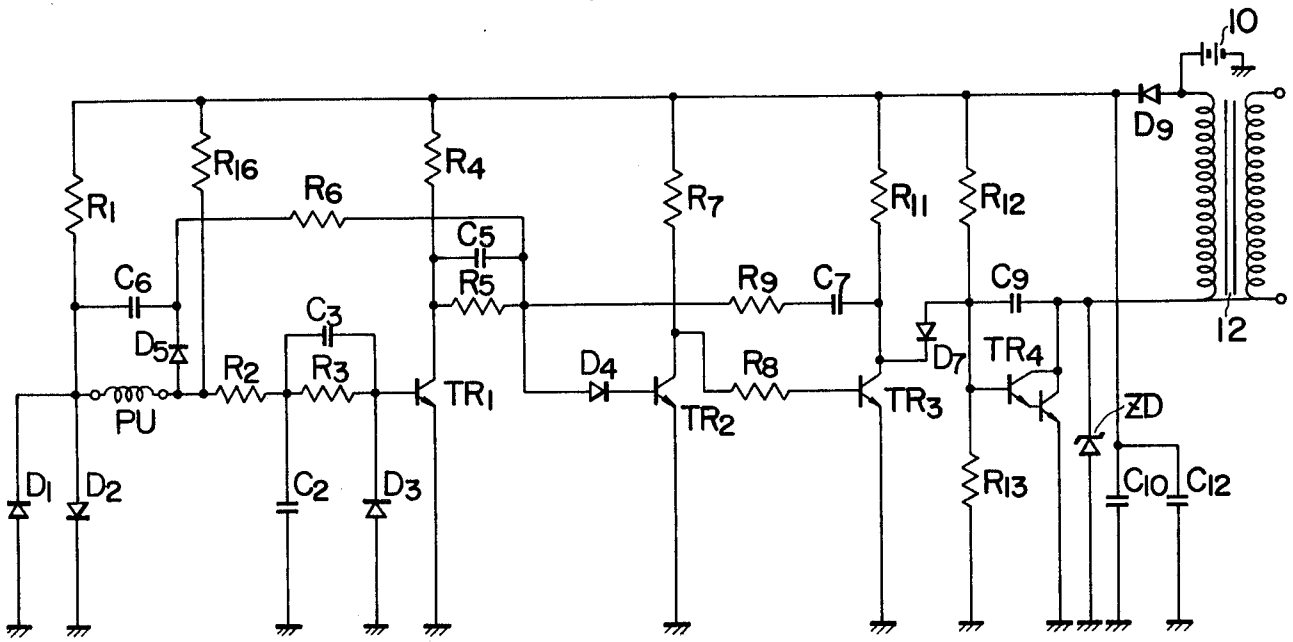
FIG. 5 shows a circuit configuration of another embodiment of the present invention.

Another embodiment of the present invention is shown in FIG. 5 and operates on the same basic principle as the circuit of FIG. 2, the difference being the manner in which the capacitor C6 is charged.

In the embodiment under consideration, the voltage corresponding to the engine revolutions is obtained by rectifying the output voltage of the pick-up coil PU through the diode D5 and storing it in the capacitor C6. By connecting the negative terminal of the capacitor C6 to the anode of the diode D2, the transistor TR1 is first energized by the signal generated in the pick-up coil PU, and then the capacitor C6 is charged with a voltage higher than the signal used for energizing the transistor TR1, by the forward voltage drop through the diode D5. Therefore, the insertion of the capacitor C6 does not cause any advantages such as a change in an ignition time.

At low engine revolutions, the terminal voltage of the capacitor C6 is so low that no ample reverse charging current flows in the capacitor C7, thus considerably lengthening the time before the transistor TR2 is turned on again. The conduction of the transistor TR2 is effected by turning the transistor TR1 from on to off states. In other words, the time point of energization of the transistor TR2 is determined by the pick-up coil PU, and so is the time point of energization of the primary coil of the ignition coil 12.

When the engine is in high revolutions, on the other hand, the terminal voltage of the capacitor C6 becomes high, and therefore even if the transistor TR1 is on, the base current of the transistor TR2 is supplied through the resistor R6 after the lapse of the time determined by the terminal voltages across the resistors R6 and R9 and the capicitors C7 and C6, from the ignition start time. As a result, even though the transistor TR1 may be in off state, the transistor TR2 is turned on thereby to turn on the transistor TR4. In this way, the energization starting time of the ignition coils is capable of being changed in accordance with the engine revolutions. Unlike the preceding embodiment eliminates the need for the capacitor C8, diode D6 and resistor R10.

Apart from the pick-up coil PU used in the above-mentioned embodiment, other means such as the contact open-close type means may be employed as the ignition time detector means.

Also, the capacitor C6 is for generating a voltage corresponding to the engine revoltions and may be replaced with equal effect by other means. This system for producing a voltage for controlling the width of a pulse output of the monostable multivibrator may be replaced by an alternative method in which a transistor is connected in series with a resistor between the cathode of the diode D4 and the power supply, so that the base current of the transistor is regulated by the voltage across the capacitor C6, thereby regulating the charge current from the power supply to the capacitor C7. This method makes it possible to reduce the capacitance of the capacitor C6.

In the embodiments shown in FIGS. 2 and 5, the resistor R16 is added for preventing the current from continuing to flow in the ignition coils when the pick-up coil is burned out. Further, since the base current of the transistor TR1 is supplied through the resistor R16, the resistor may be increased in value and the current flowing through the diode D2 reduced.

What is claimed is:

1. In an ignition apparatus for an internal combustion engine comprising:

means for generating an AC signal with a waveform having zero-level crossing points corresponding to an ignition timing and changing in predetermined time relationship with engine revolutions;

a DC power supply; an ignition coil having at least a primary winding;

an ignition coil having at least a primary winding;

a first switching transistor for producing a primary current flowing from said DC power supply into said primary winding of the ignition coil;

a second switching transistor being rendered respectively conductive and nonconductive in accordance with the waveform of the AC signal from said AC signal generating means; and a switching circuit for rendering said first transistor respectively conductive and nonconductive in response to the output of said second switching transistor during low engine speed operation, to thereby cause primary current to flow through the primary winding of said ignition coil in accordance with a prescribed relationship between the threshold level of said second switching transistor and the waveform of said AC signal and then to interrupt the primary current for producing a high voltage at the output terminal of said ignition coil in response to said zero-level crossing points of the wave-form of said AC signal;

the improvement further comprising:

means for generating a voltage in accordance with the revolutions of said engine;

means for generating pulses the widths of which vary in accordance with the output of said voltage generating means; and OR gate means for rendering said first transistor respectively conductive and nonconductive in response to the outputs from said second switching transistor during low engine speed operation and in response to the outputs from said pulse generating means during high engine speed operation, to thereby produce said high voltage at the output terminal of said ignition coil.

2. An ignition apparatus for the internal combustion engine according to claim 1, wherein said pulse generator means is a monostable multivibrator having at least a couple of transistors and at least one time-constant circuit, said voltage generator means producing an output for regulating the discharge time of the capacitor included in said time constant circuit.

3. An ignition apparatus for an internal combustion engine according to claim 1, wherein said AC signal generating means further comprises:

a pick-up coil for generating the AC signal, means for connecting said pick-up coil and the base of said second switching transistor to apply the output from said pick-up coil to said second switching transistor; and a resistor connected between said connecting means and said DC power supply.

4. In an ignition apparatus for an internal combustion engine having means for generating an AC signal in synchronism with engine revolutions, a power supply, and ignition coil, and a first switching circuit coupled to said power supply and said ignition coil, for controllably switching current through said ignition coil, the improvement comprising:

first means, coupled to said AC signal generating means, for producing a first switching signal the level of which is switched between first and second voltage levels in synchronism with the variation of the level of said AC signal about a prescribed therehold value;

second means, coupled to said first means, for producing a second switching signal, the level of which is switched between a pair of voltage values, which is applied to said first switching circuit controllably switch the current through said ignition coil; and third means, coupled to said first and second means, for causing said second switching signal produced by said second means to be switched between said pair of voltage values in synchronism with the switching of said first switching signal between said first and second voltage levels during low engine revolution speeds, and for causing said second switching signal to be switched between said pair of voltage values in advance of the switching of said first switching signal between said first and second voltage levels and thereby advance the switching of current through said ignition coil, during high engine revolution speeds; and wherein said second means comprises a monostable multivibrator circuit having a variable time constant such that, for low engine revolution speeds the state of said monostable multivibrator circuit depends only upon the voltage level of said first switching signal, and for high engine revolution speeds, the state of said monostable multivibrator circuit is not exclusively determined by the voltage level of said first switching signal.

5. The improvement according to claim 4, wherein the second switching signal produced by said monostable multivibrator is a pulse signal, the width of which corresponds to the length of time that said first switching signal is below said prescribed threshold level during low engine revolution speeds, and the width of which increases with engine revolution speed during high engine revolution speeds.

6. In an ignition apparatus for an internal combustion engine comprising:

means for generating an AC signal in time relationship with engine revolutions;

a DC power supply;

an ignition coil having at least a primary winding;

a first switching transistor for producing a primary current flowing from said DC power supply into said primary winding of the ignition coil;

first connecting means for connecting the primary winding and the first switching transistor in series across the output terminals of the DC power supply;

a second switching transistor being rendered conductive or nonconductive in response to the voltage value of the AC signal from said AC signal generating means; and second connecting means for applying the AC signal to the base of the second switching transistor;

the improvement further comprising a third transistor;

third connecting means for connecting the base of the third transistor to the output of the second switching transistor;

a fourth transistor for controlling the first switching transistor to produce or interrupt the primary current in the primary winding of said ignition coil;

fourth connecting means for applying the output of the third transistor to the base of the fourth transistor;

a capacitor connected between the output of the fourth transistor and the base of the third transistor;

voltage generating means for producing a voltage in accordance with the revolutions of said engine; and fifth connecting means for connecting the output of the voltage generating means to the base of the third transistor.

* * * * *